US010808712B2

(12) United States Patent
Stoyanov et al.

(10) Patent No.: US 10,808,712 B2
(45) Date of Patent: Oct. 20, 2020

(54) INTERFERENCE FIT WITH HIGH FRICTION MATERIAL

(71) Applicant: United Technologies Corporation, Farmington, CT (US)

(72) Inventors: Pantcho Stoyanov, West Hartford, CT (US); William J. Joost, Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 237 days.

(21) Appl. No.: 15/928,867

(22) Filed: Mar. 22, 2018

(65) Prior Publication Data

US 2019/0293079 A1 Sep. 26, 2019

(51) Int. Cl.

| | |
|---|---|
| ***F04D 29/32*** | (2006.01) |
| ***F04D 29/02*** | (2006.01) |
| ***F01D 5/06*** | (2006.01) |
| ***F01D 5/02*** | (2006.01) |

(52) U.S. Cl.

CPC ..... *F04D 29/023* (2013.01); *F01D 5/026* (2013.01); *F01D 5/066* (2013.01); *F04D 29/322* (2013.01); *F05D 2230/31* (2013.01); *F05D 2230/40* (2013.01); *F05D 2260/37* (2013.01); *F05D 2260/402* (2013.01); *F05D 2300/516* (2013.01); *F05D 2300/60* (2013.01); *F05D 2300/701* (2013.01)

(58) Field of Classification Search

None

See application file for complete search history.

(56) References Cited

U.S. PATENT DOCUMENTS

| | | | | |
|---|---|---|---|---|
| 5,139,389 | A * | 8/1992 | Eng | F01D 5/3007 416/219 R |
| 7,448,221 | B2 * | 11/2008 | Suciu | F01D 5/066 415/141 |
| 7,588,650 | B2 | 9/2009 | Baba et al. | |
| 7,912,587 | B2 * | 3/2011 | Walters | F01D 5/027 324/154 R |
| 8,403,645 | B2 * | 3/2013 | Barnes | F01D 5/143 416/234 |
| 8,459,943 | B2 * | 6/2013 | Schutte | F01D 5/066 415/199.4 |
| 10,450,895 | B2 * | 10/2019 | Amadon | F01D 25/24 |

(Continued)

FOREIGN PATENT DOCUMENTS

| | | | |
|---|---|---|---|
| DE | 3237096 | A1 | 4/1984 |
| DE | 102010040288 | A1 | 3/2012 |
| WO | WO-2015023860 | A1 * | 2/2015 |

OTHER PUBLICATIONS

European Search Report for European Application No. 19163805.5 dated Aug. 5, 2019, 7 pages.

*Primary Examiner* — Michael Lebentritt

(74) *Attorney, Agent, or Firm* — Cantor Colburn LLP

(57) ABSTRACT

Disclosed is a rotating component for a turbine engine including a first rotating component having a first snap surface and a second rotating component having a second snap surface wherein the first snap surface is configured to interlock with the second snap surface, and further wherein at least one of the first snap surface and the second snap surface have a friction enhancing material.

18 Claims, 5 Drawing Sheets

(56) References Cited

U.S. PATENT DOCUMENTS

| | | | | |
|---|---|---|---|---|
| 2004/0113519 | A1* | 6/2004 | Mentesana | H02N 2/0065 310/323.09 |
| 2006/0099070 | A1* | 5/2006 | Suciu | F01D 5/066 415/199.5 |
| 2007/0014667 | A1* | 1/2007 | Pickens | F01D 5/3038 416/193 A |
| 2013/0266421 | A1 | 10/2013 | Benjamin et al. | |
| 2014/0072408 | A1 | 3/2014 | Watz et al. | |
| 2014/0119943 | A1* | 5/2014 | Tarczy | F01D 5/3069 416/96 R |
| 2015/0315925 | A1* | 11/2015 | Budnick | F02C 7/28 415/214.1 |
| 2017/0138368 | A1* | 5/2017 | Maalouf | F02C 3/04 |

* cited by examiner

INTERFERENCE FIT WITH HIGH FRICTION MATERIAL

BACKGROUND

Exemplary embodiments pertain to the art of gas turbine engines, and more particularly to rotating components of gas turbine engines.

Gas turbine engines, such as those used to power modern aircraft, generally include a compressor section to pressurize an airflow, a combustor section for burning hydrocarbon fuel in the presence of the pressurized air, and a turbine section to extract energy from the resultant combustion gases. The airflow flows along a gaspath through the gas turbine engine.

The gas turbine engine includes a plurality of rotors arranged along an axis of rotation of the gas turbine engine, in both the compressor section and the turbine section. At least some of these rotors are connected to axially adjacent rotors, spacers, or other rotating components via interference fit, also known in the art as a "snap fit". The areas surrounding the interference fit and the surfaces forming the interference fit can experience a significant amount of wear and stress. Accordingly, improved materials are desired for a more effective and efficient interference fit.

BRIEF DESCRIPTION

Disclosed is a rotating component for a turbine engine including a first rotating component having a first snap surface and a second rotating component having a second snap surface wherein the first snap surface is configured to interlock with the second snap surface, and further wherein at least one of the first snap surface and the second snap surface have a friction enhancing material.

In addition to one or more of the features described above, or as an alternative to any of the foregoing embodiments, the first rotating component is a first rotor and the second rotating component is a second rotor.

In addition to one or more of the features described above, or as an alternative to any of the foregoing embodiments, the first rotating component is a rotor and the second rotating component is a spacer.

In addition to one or more of the features described above, or as an alternative to any of the foregoing embodiments, the friction enhancing material comprises high friction oxides. The high friction oxides may comprise chromium oxide, aluminum oxide, manganese oxide, iron oxide, nickel oxide, titanium oxide, and combinations thereof.

In addition to one or more of the features described above, or as an alternative to any of the foregoing embodiments, the friction enhancing layer has a thickness less than or equal to 2 micrometers and greater than or equal to an atomic layer.

In addition to one or more of the features described above, or as an alternative to any of the foregoing embodiments, the first snap surface and the second snap surface have a friction enhancing material.

Also disclosed is a method of making a rotating component for a turbine engine including forming a friction enhancing material on a first snap surface of a rotating component and contacting the friction enhancing material with a second snap surface of a second rotating component.

In addition to one or more of the features described above, or as an alternative to any of the foregoing embodiments, the first snap surface comprises nickel and the friction enhancing material is formed by exposure to a temperature greater than or equal to 1000° F. (538° C.) for 1 to 24 hours.

In addition to one or more of the features described above, or as an alternative to any of the foregoing embodiments, the first snap surface comprises titanium and the friction enhancing material is formed by exposure to a temperature greater than or equal to 500° F. (260° C.) for 0.5 to 24 hours.

In addition to one or more of the features described above, or as an alternative to any of the foregoing embodiments, further comprising forming a friction enhancing material on the second snap surface prior to contacting the friction enhancing material on the first snap surface with the second snap surface of the second rotating component.

In addition to one or more of the features described above, or as an alternative to any of the foregoing embodiments, the friction enhancing material is formed by thermal spray deposition.

In addition to one or more of the features described above, or as an alternative to any of the foregoing embodiments, the friction enhancing material is formed by chemical vapor deposition.

In addition to one or more of the features described above, or as an alternative to any of the foregoing embodiments, the friction enhancing material is formed by plasma vapor deposition.

In addition to one or more of the features described above, or as an alternative to any of the foregoing embodiments, the friction enhancing material is formed by atomic layer deposition.

In addition to one or more of the features described above, or as an alternative to any of the foregoing embodiments, the friction enhancing material comprises high friction oxides. The high friction oxides comprise chromium oxide, aluminum oxide, manganese oxide, iron oxide, nickel oxide, titanium oxide, and combinations thereof.

In addition to one or more of the features described above, or as an alternative to any of the foregoing embodiments, the friction enhancing layer has a thickness less than or equal to 2 micrometers and greater than or equal to an atomic layer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
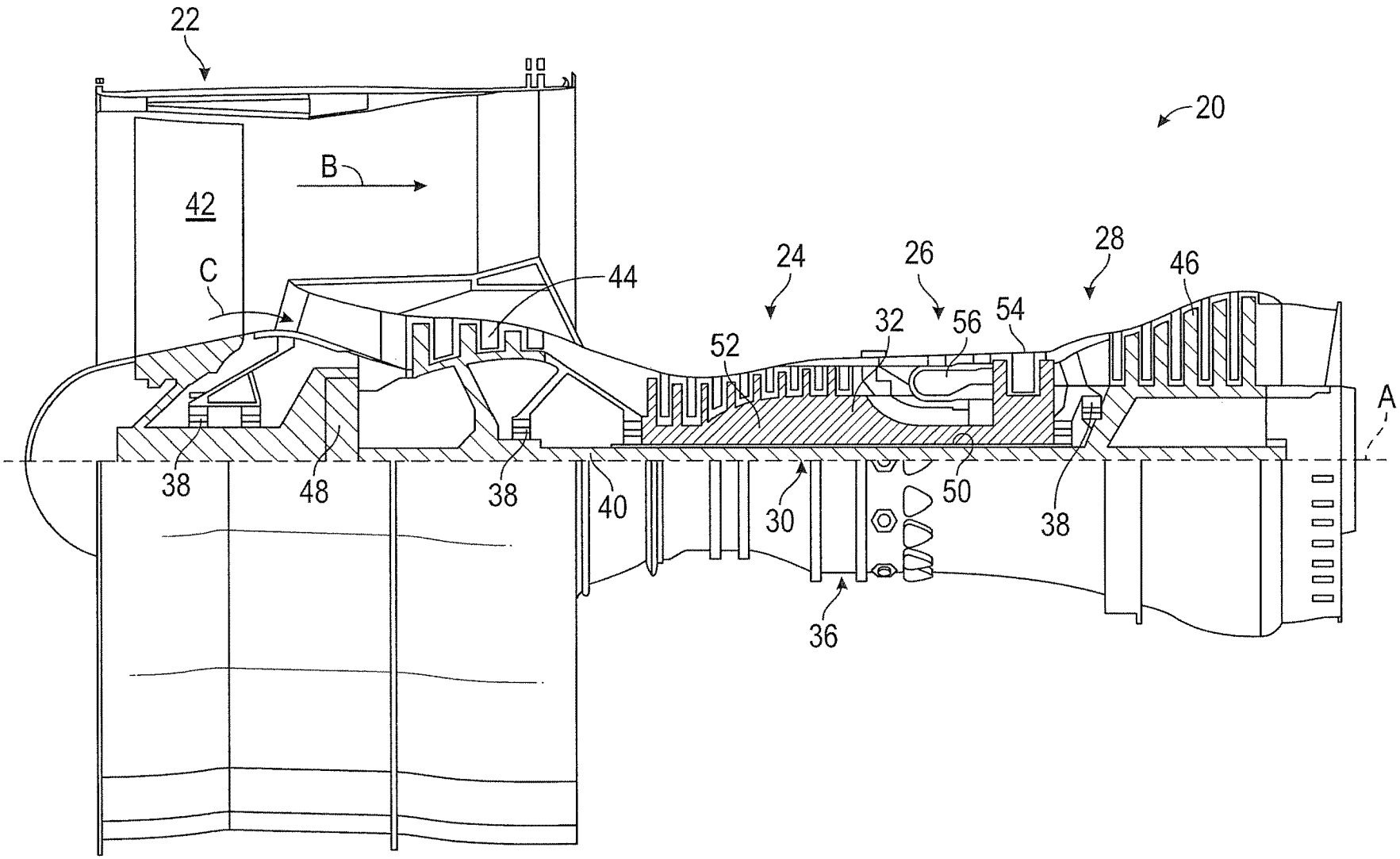
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
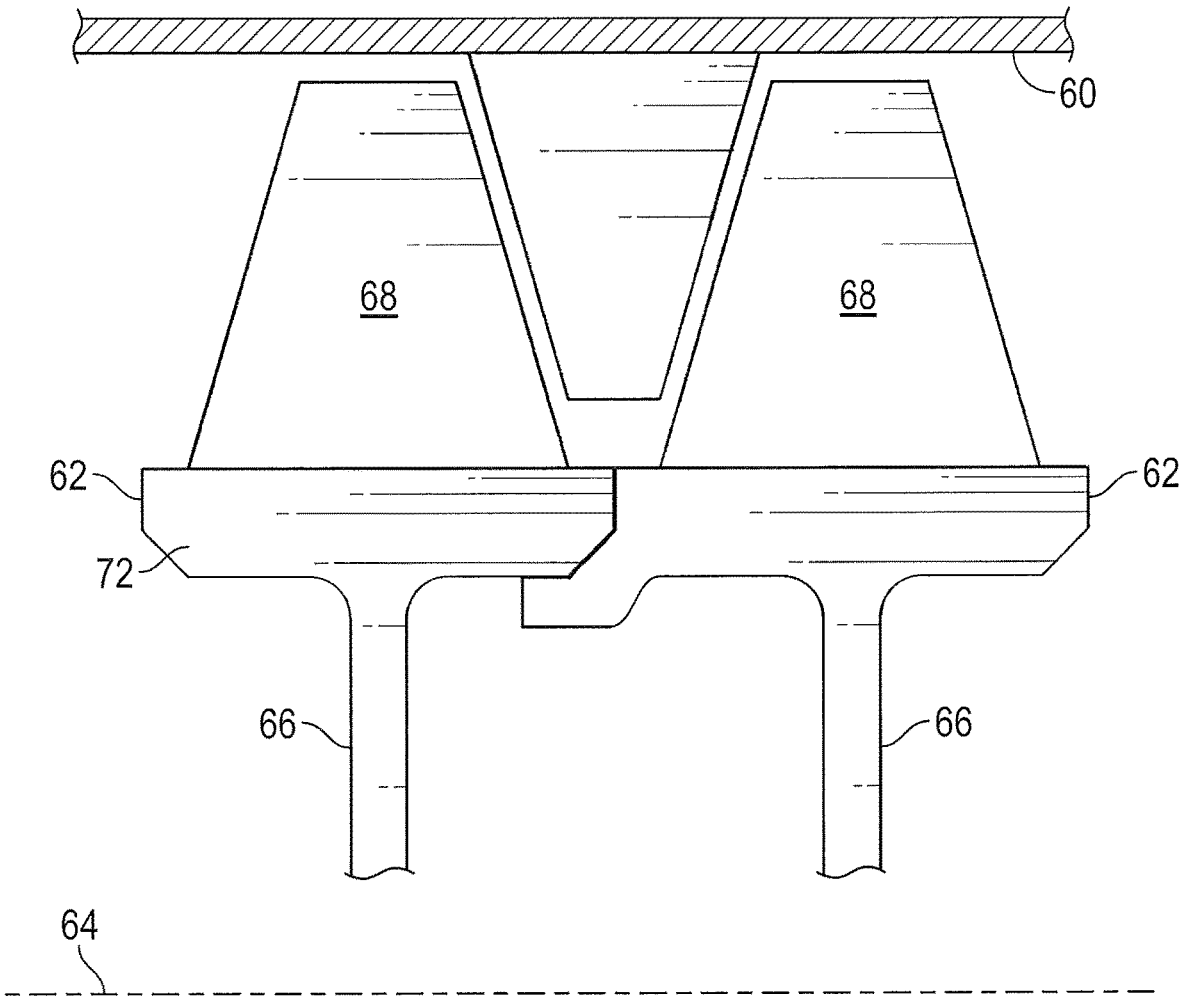
FIG. 2 is a partial cross-sectional view of an embodiment of a compressor of a gas turbine engine.

Referring now to FIG. 2, the compressor (either low pressure compressor 44 or high pressure compressor 52) includes a compressor case 60, in which the compressor rotors 62 are arranged along an engine axis 64 about which the compressor rotors 62 rotate. Each compressor rotor 62 includes a rotor disc 66 with a plurality of rotor blades 68 extending radially outwardly from the rotor disc 66. In some embodiments the rotor disc 66 and the plurality of rotor blades 68 are a single, unitary structure, an integrally bladed compressor rotor 62. In other embodiments, the rotor blades 68 are each installed to the rotor disc 66 via, for example, a dovetail joint where a tab or protrusion at the rotor blade 68 is inserted into a corresponding slot in the rotor disc 66.

Figure 3:
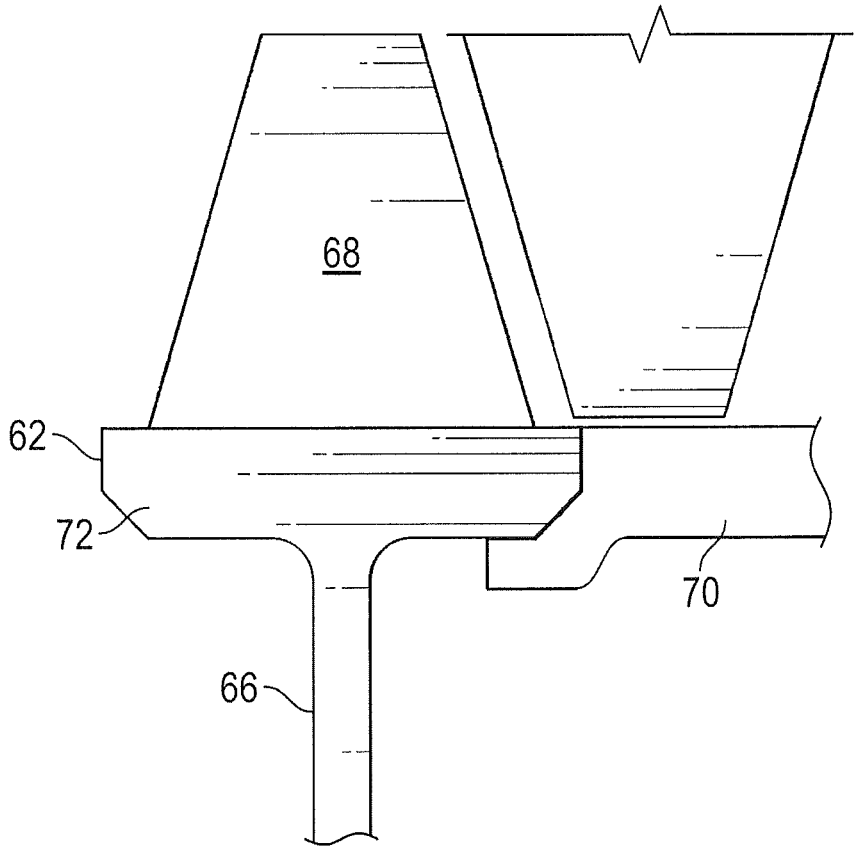
FIG. 3 is a partial cross-sectional view of another embodiment of a compressor of a gas turbine engine.

As shown in FIG. 2, axially adjacent compressor rotors 62 may be joined to each other, while in other embodiments, as shown in FIG. 3, the compressor rotor 62 may be joined to another rotating component, such as a spacer 70. The compressor rotor 62 is secured to the adjacent rotating component by an interference fit, which in some embodiments is combined with another mechanical fastening, such as a plurality of bolts (not shown) to secure the components.

Figure 4:
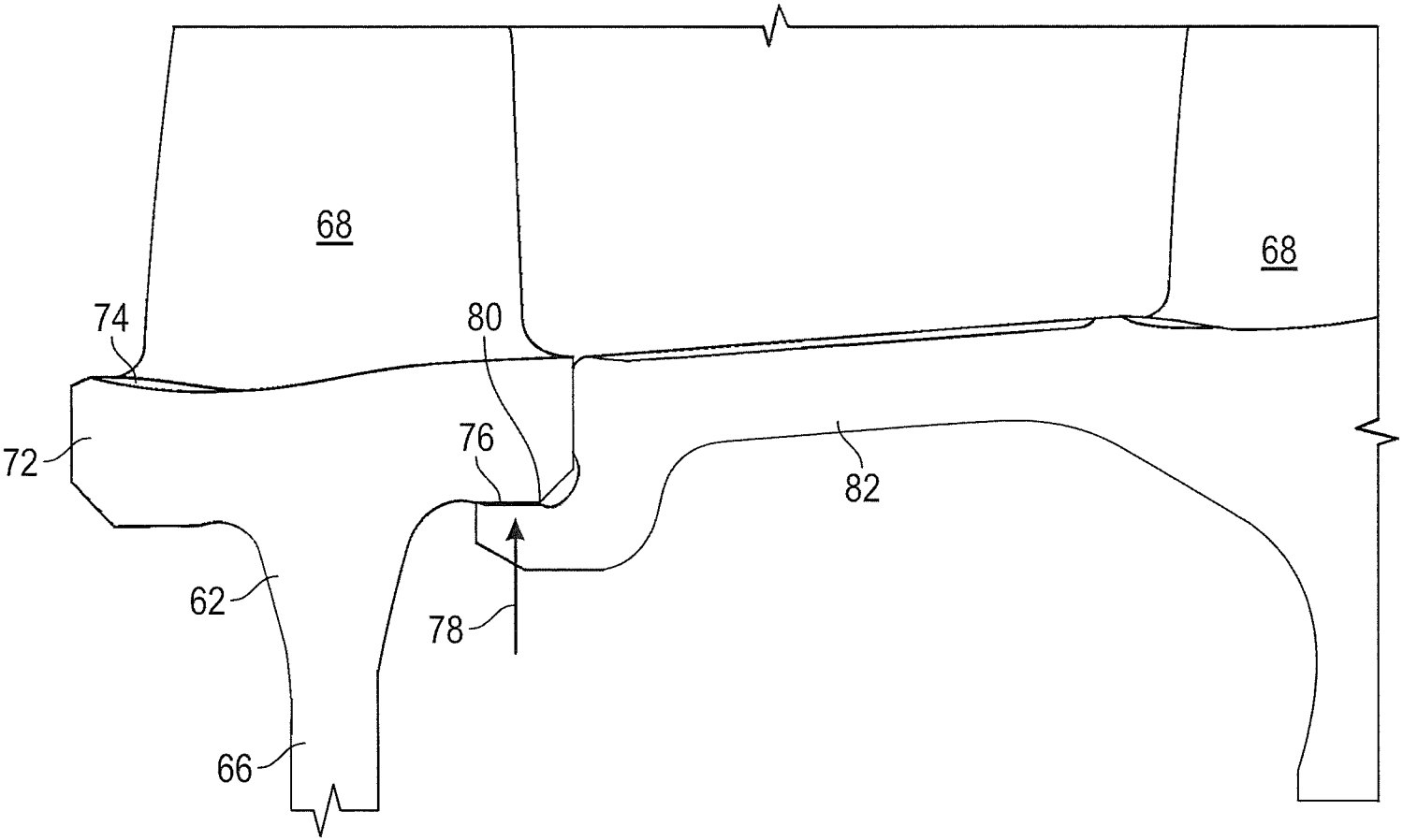
FIG. 4 is a partial cross-sectional view of an embodiment of a compressor rotor of a gas turbine engine.

Referring now to FIG. 4, a more detailed view of the interference fit, also referred to as a "snap fit", between the compressor rotor 62 and the adjacent rotating component is shown. Compressor rotor 62, as stated above, includes a plurality of rotor blades 68 secured to, and radially extending from a rotor disc 66. In particular, the rotor blades 68 extend from a blade platform 72 portion of the rotor disc 66. The blade platform 72 extends in a substantially axial direction, and includes a flowpath surface 74 that defines an inner boundary of a flowpath of the gas turbine engine. A radially inboard platform surface 76, opposite the flowpath surface 74 and radially inboard therefrom, defines a rotor snap surface 78. The rotor snap surface 78 interfaces with an adjacent component snap surface 80 to join the compressor rotor 62 and the adjacent component 82.

In their respective free, unrestrained states, and when unjoined, the adjacent component snap surface 80 is larger than the rotor snap surface 78. To join the component the compressor rotor 62 may be heated and/or the adjacent component 82 may be cooled to temporarily enlarge the rotor snap surface 78 and/or temporarily cool the adjacent component snap surface 80, respectively. The component then may be joined, and when returned to ambient temperature the desired interference fit is achieved between the rotor snap surface 78 and the adjacent component snap surface 80.

The interaction between rotor snap surface 78 and adjacent component snap surface 80 is highly dependent on the static friction behavior of the interface between the two surfaces. Increasing the static friction coefficient of the interface allows for improved rotor design and a reduction in load on other portions of the rotor. Increased static friction coefficient can be achieved by forming friction enhancing material on the snap surfaces. The friction enhancing material comprises high friction oxides. Exemplary high friction oxides include chromium oxide, aluminum oxide, manganese oxide, iron oxide, nickel oxide, titanium oxide, and combinations thereof. The friction enhancing layer has a thickness less than or equal to 2 micrometers and greater than or equal to an atomic layer.

The friction enhancing material can be formed by exposing the rotor snap surface, the adjacent component snap surface or both to an elevated temperature for a desired period of time. For example, a snap surface comprising a nickel based alloy may be exposed to a temperature greater than 1000° F. (538° C.), or greater than 1200° F. (649° C.), for 1 to 24 hours. A snap surface comprising a titanium based alloy may be exposed to a temperature greater than 500° F. (260° C.), or greater than 800° F. (427° C.), for 0.5 to 24 hours. When the friction enhancing material is formed by heat treatment the oxides are formed from elements present in the alloy that makes up the snap surface.

In some embodiments the friction enhancing material is deposited by thermal spray, chemical vapor deposition, plasma vapor deposition or atomic layer deposition. Use of a deposition method allows the composition of the friction enhancing method to be tailored as desired. When the friction enhancing material is deposited the rotor snap surface, the adjacent component snap surface or both may comprise a cobalt based alloy, a nickel based alloy, a titanium based alloy or a combination thereof.

Example

Static friction coefficient experiments were performed using a custom-built high temperature apparatus in a flat-on-flat configuration. Briefly, a load cell located on the upper and lower portion of the rig was used to measure the friction force, while a static normal load was applied and measured using load cells on each side of the plate. A servo-hydraulically driven actuator controlled the displacement and frequency of the plate relative to the stationary pin. The tests were performed at room temperature and elevated temperatures of 430° C. and 665° C. using normal stresses of 117 megapascals (MPa) for a total displacement of 2.5 millimeters (mm) at a rate of 5.1 mm/minute. Initial tests were performed in displacement control but the data did not show a clear change or interruption in rate for both axial load and displacement to determine the breakaway point for the static coefficient of friction. It should be noted that the displacement is not necessarily linear due to some possible bending in the system. The static coefficient of friction breakaway load was determined by finding the maximum load prior to a change in load and displacement. The static friction numbers are normalized, such that each coefficient of friction is divided by the lowest common denominator.

The static friction coefficient of Inconel 718 (a nickel alloy with greater than weight percent Cr) was investigated when in contact against itself, another nickel alloy (also with greater than 10 weight percent Cr), and a titanium alloy. All material couples were tested at room temperature and elevated temperature. The elevated temperature test of the titanium alloy counterface was performed at 430° C., while all other couples were tested at 665° C.

The static coefficient of friction was higher for the tests performed at elevated temperature (i.e. 430° C. and 665° C.). In addition, the scatter for the static friction values at elevated temperatures was larger compared to the ones performed at room temperature. Interestingly, no significant difference is observed in the static friction coefficient values between the different counterfaces against Inconel 718 when tested at room temperature. Similarly, the static friction was similar for the different counterfaces at elevated temperatures.

Figure 5:
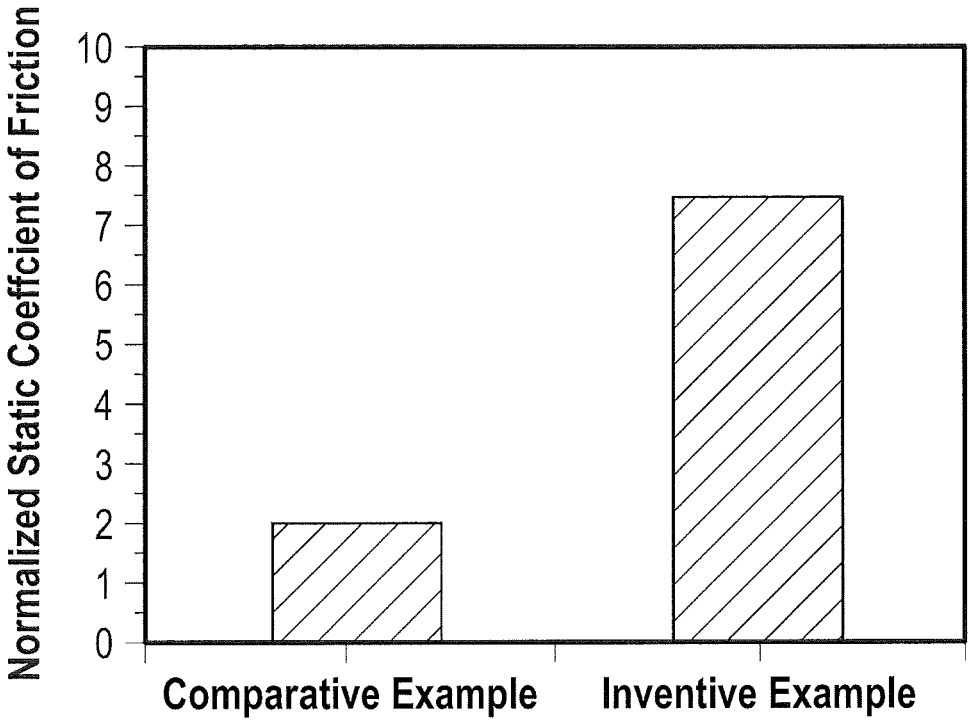
FIG. 5 is a graph of data obtained in the Examples.

In order to better understand the influence of the oxidation behavior on the interfacial processes, the static friction was evaluated of Inconel 718 against itself at room temperature after exposure at 665° C. for up to 24 hours. The average value static friction value is shown in FIG. 5. The comparative example is non-heat treated Iconel 718 evaluated against itself. The inventive example is Iconel 718 having a friction enhancing material on the surface due to exposure to 665° C. for up to 24 hours evaluated against itself. The static friction is significantly higher compared to all other values tested at room temperature. Interestingly, the static friction value after high temperature exposure is also on average higher compared to all other measurements at elevated temperature.

The surfaces for Inconel 718 samples tested at room temperature and elevated temperatures were examined by scanning electron microscopy (SEM). As expected, the oxidation behavior of the unworn surfaces was different between the samples tested at room temperature and high temperature. The elemental mapping of the Inconel 718 tested at high temperature revealed the formation of a thin oxide layer on the surface. In addition, a chromium layer is visible on the surface suggesting the possibility of chromium oxide. The cross-sectional images on the coupons tested at room temperature, on the other hand, did not show any visible oxide layer.

X-ray photoelectron spectroscopy (XPS) was performed in order to provide a better understanding of the oxidation behavior for the tests at elevated temperatures. Similar to the cross-sectional SEM images, the XPS analysis revealed a high concentration of metal oxide in the surface near region. The metal oxide was mainly in form of iron oxides (i.e. $Fe_3O_4$, $Fe_2O_3$) and chromium oxides (i.e. $Cr_2O_3$, $CrO_3$). In addition, some amount of manganese-based oxides were also observed in the form of Mn(OH)O and $MnCr_2O_4$.

Cross-sectional SEM images for the titanium samples were also taken. Similarly to the Inconel 718, the titanium showed nearly no oxide on the surface of the samples tested at room temperature. However, an oxygen rich layer was observed after testing at elevated temperatures, possibly in the form of aluminum oxide.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A rotating component for a turbine engine comprising a first rotating component having a first snap surface comprising a nickel alloy or a titanium alloy and a second rotating component having a second snap surface comprising a nickel alloy or a titanium alloy wherein the first snap surface is configured to interlock with the second snap surface, and further wherein at least one of the first snap surface and the second snap surface have a friction enhancing material formed from the alloy of the snap surface.

2. The rotating component of claim 1, wherein the first rotating component is a first rotor and the second rotating component is a second rotor.

3. The rotating component of claim 1, wherein the first rotating component is a rotor and the second rotating component is a spacer.

4. The rotating component of claim 1, wherein the friction enhancing material comprises high friction oxides.

5. The rotating component of claim 4, wherein the high friction oxides comprise chromium oxide, aluminum oxide, manganese oxide, iron oxide, nickel oxide, titanium oxide, and combinations thereof.

6. The rotating component of claim 1, wherein the friction enhancing layer has a thickness less than or equal to 2 micrometers and greater than or equal to an atomic layer.

7. The rotating component of claim 1, wherein the first snap surface and the second snap surface have a friction enhancing material.

8. A method of making a rotating component for a turbine engine comprising forming a friction enhancing material from a first snap surface of a rotating component, wherein the first snap surface comprises a nickel alloy or a titanium alloy and contacting the friction enhancing material with a second snap surface of a second rotating component.

9. The method of claim 8, wherein the first snap surface comprises a nickel alloy and the friction enhancing material is formed from the nickel alloy by exposure to a temperature greater than or equal to 1000° F. (538° C.) for 1 to 24 hours.

10. The method of claim 8, wherein the first snap surface comprises a titanium alloy and the friction enhancing material is formed from the titanium alloy by exposure to a temperature greater than or equal to 500° F. (260° C.) for 0.5 to 24 hours.

11. The method of claim 8, further comprising forming a friction enhancing material on the second snap surface prior to contacting the friction enhancing material on the first snap surface with the second snap surface of the second rotating component.

12. The method of claim 8, wherein the friction enhancing material is formed by thermal spray deposition.

13. The method of claim 8, wherein the friction enhancing material is formed by chemical vapor deposition.

14. The method of claim 8, wherein the friction enhancing material is formed by plasma vapor deposition.

15. The method of claim 8, wherein the friction enhancing material is formed by atomic layer deposition.

16. The method of claim 8, wherein the friction enhancing material comprises high friction oxides.

17. The method of claim 16, wherein the high friction oxides comprise chromium oxide, aluminum oxide, manganese oxide, iron oxide, nickel oxide, titanium oxide, and combinations thereof.

18. The method of claim 8, wherein the friction enhancing layer has a thickness less than or equal to 2 micrometers and greater than or equal to an atomic layer.

* * * * *